US005148839A

United States Patent [19]

Kirwan et al.

[11] Patent Number: 5,148,839

[45] Date of Patent: Sep. 22, 1992

[54] VALVE ASSEMBLIES FOR FILLING CONTAINERS WITH PRESSURIZED GAS

[76] Inventors: Lee D. Kirwan, 1223 Thistledown Avenue; Roger C. Hurst, 1253 Thistledown Avenue, both of Sarnia, Ontario, Canada, N7S 5A8

[21] Appl. No.: 879,260

[22] Filed: May 6, 1992

[51] Int. Cl.[5] ..... B65B 31/00

[52] U.S. Cl. ..... 141/1; 141/48; 141/49; 137/614; 137/625.22; 137/625.24

[58] Field of Search ..... 141/348, 349, 29, 1, 141/48, 49, 50; 137/614, 625.2, 625.22, 625.24

[56] References Cited

U.S. PATENT DOCUMENTS 3,460,589 8/1969 Justis ..... 141/48 X 4,532,969 8/1985 Kwaan ..... 141/29 X

*Primary Examiner*—Alan Cohan

*Attorney, Agent, or Firm*—Rogers & Scott

[57] ABSTRACT

A valve assembly operable to fill a container with pressurized gas from a source thereof and to vent the cylinder and associated passage means in the valve assembly to atmosphere, the cylinder having a valve with a valve member spring biased to a closed position. The valve assembly has a valve housing within a main chamber, a supply port connectable to a source of pressurized gas, a fill port connectable to a cylinder to be filled, and a vent port communicating with the atmosphere, the supply port, fill port and vent port communicating with the main chamber. A valve body is mounted in the main chamber for movement therein and having a first passage operable in a first position of the valve body to connect the fill port to the vent port, a second passage operable in a second position of the valve body to connect the supply port to the fill port, and a third passage operable in a third position of the valve body to connect the fill port to the vent port. A valve opening member is movably mounted in the valve housing and actuated by the valve body when the body is moved to the second and third positions to engage and move the valve member of a cylinder secured to the fill port to an open position.

4 Claims, 2 Drawing Sheets

VALVE ASSEMBLIES FOR FILLING CONTAINERS WITH PRESSURIZED GAS

Figure 1:
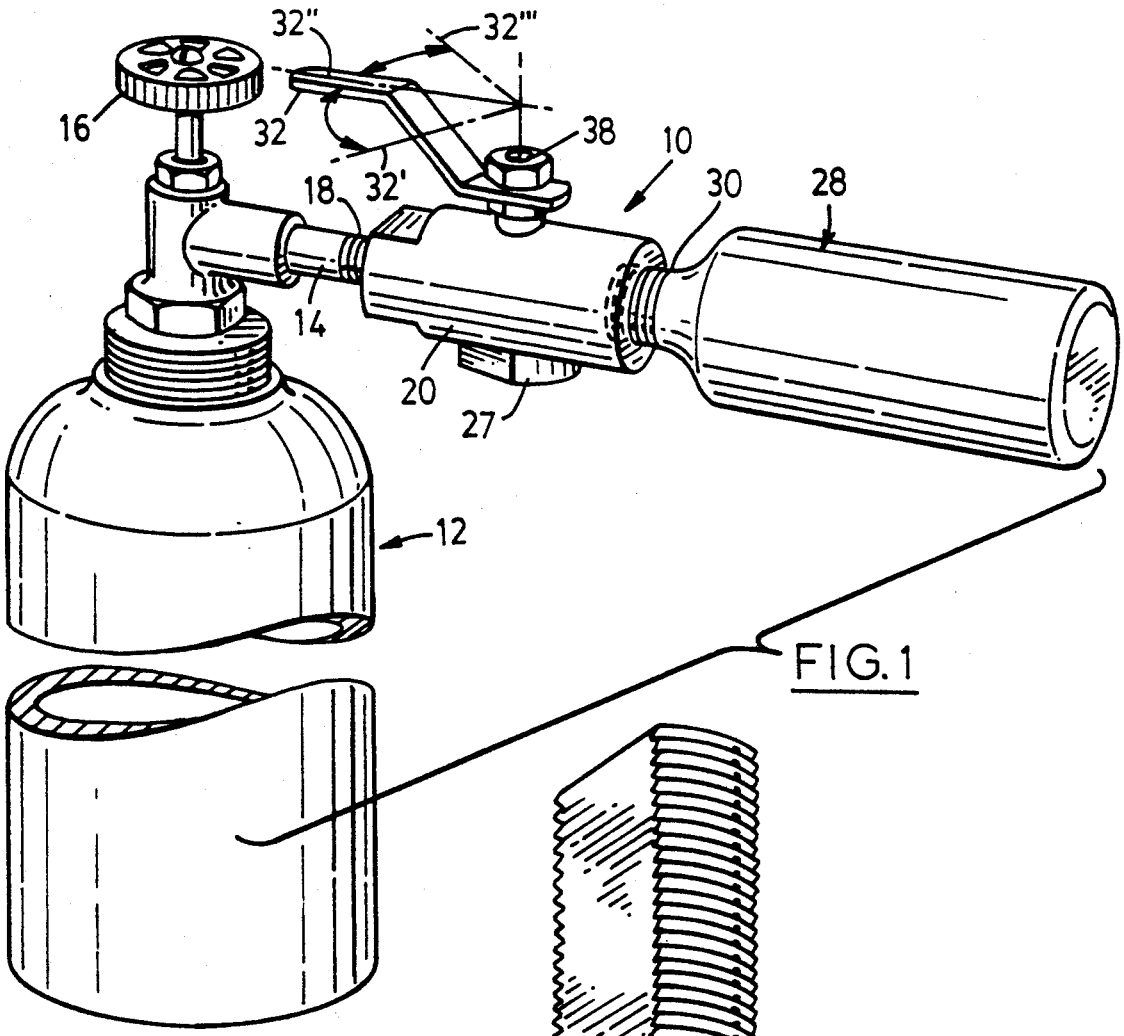

This invention relates to valve assemblies for filling containers with pressurized gas.

Pressurized gas cylinders usually have a valve with a valve member spring biased to a closed position. Various valve assemblies have been used in the past for filling such containers. Usually, the arrangement is such that the valve assembly can be vented to atmosphere when a cylinder has been filled so that the cylinder can safely be disconnected from the valve assembly.

Recently, a sport known as Paintball has become popular, particularly in the United States. In this sport, a gun is used to fire projectiles at an opponent. The projectiles contain paint of a predeterminded colour and burst upon hitting an opponent so that the paint is deposited on the opponent. The projectile is propelled from the gun by a pressurized gas, usually carbon dioxide, the gas being supplied from a small cylinder which is attached to the gun.

It is necessary to refill such containers from time to time, usually from a large supply cylinder. Since the cylinder attached to the gun is relatively small, it is desirable for such a container to be filled with as much gas as possible. When carbon dioxide is used, the usual technique is to fill a gun cylinder with carbon dioxide gas, vent the cylinder to quickly release the gas therefrom, thereby substantially cooling the cylinder, and then refilling the cylinder. More gas can be put into the gun cylinder when it is filled in this manner, i.e. when the gas is put into a cylinder which has been cooled below atmospheric temperature.

At the present time, such filling, venting and refilling is carried out at Paintball sport locations with various types of "off the shelf" valves connected to a supply cylinder, such valves being not only time consuming to operate but also somewhat dangerous because they are not designed for such use.

It is therefore an object of the invention to provide a valve assembly which is especially useful for filling containers intended for use with paintball guns.

According to one aspect of the invention, a valve assembly operable to fill a cylinder with pressurized gas from a source thereof and to vent the cylinder and associated passage means in the valve assembly to atmosphere, the cylinder having a valve with a valve member spring biased to a closed position, comprises a valve housing having a main chamber, a supply port connectable to a source of pressurized gas, a fill port connectable to a cylinder to be filled, and a vent port communicating with the atmosphere, the supply port, fill port and vent port communicating with the main chamber. A valve body is mounted in the main chamber for movement therein and has first passage means operable in a first position of the valve body to connect the fill port to the vent port, second passage means operable in a second position of the valve body to connect the supply port to the fill port and third passage means operable in a third position of the valve body to conect the fill port to the vent port. A valve opening member is movably mounted in the valve housing and is actuated by the valve body when the valve body is moved to said second and third positions to engage and move the valve member of a cylinder secured to the fill port to an open position. Means are provided for positioning the valve body in the first, second and third positions.

When a source of pressurized gas is connected to the supply port and a cylinder is connected to the fill port, positioning of the valve body in the first position causes the fill port to be vented through the first passage means and the vent port to the atmosphere, positioning the valve body in the second position causes the cylinder to be filled with gas from the source thereof, said gas passing through the second passage means, the fill port and the now-open cylinder valve to enter the cylinder, and positioning of the valve body in the third position causes the cylinder to be vented through the open cylinder valve, the fill port, the third passage means and the vent port to the atmosphere.

The valve assembly may also include means to prevent the valve body from being moved from the first position directly to the third position or vice-versa without passing through the second position.

The valve body may be angularly movable in the housing to said first, second and third positions.

According to another aspect of the invention, a method of filling a cylinder with pressurized gas from a source thereof, said cylinder having a valve with a valve member spring biased to a closed position, includes positioning the valve body of the valve assembly referred to above in the first position to vent the fill port to the atmosphere, connecting a source of pressurized gas to the supply port, connecting a cylinder to the fill port, positioning the valve body in the second position to fill the cylinder with gas from the source thereof, positioning the valve body in the third position to vent the cylinder to the atmosphere, positioning the valve body in the second position to fill the cylinder with gas, and positioning the valve body in the first position to vent the fill port to the atmosphere. The cylinder can then be disconnected from the valve assembly.

Figure 2:
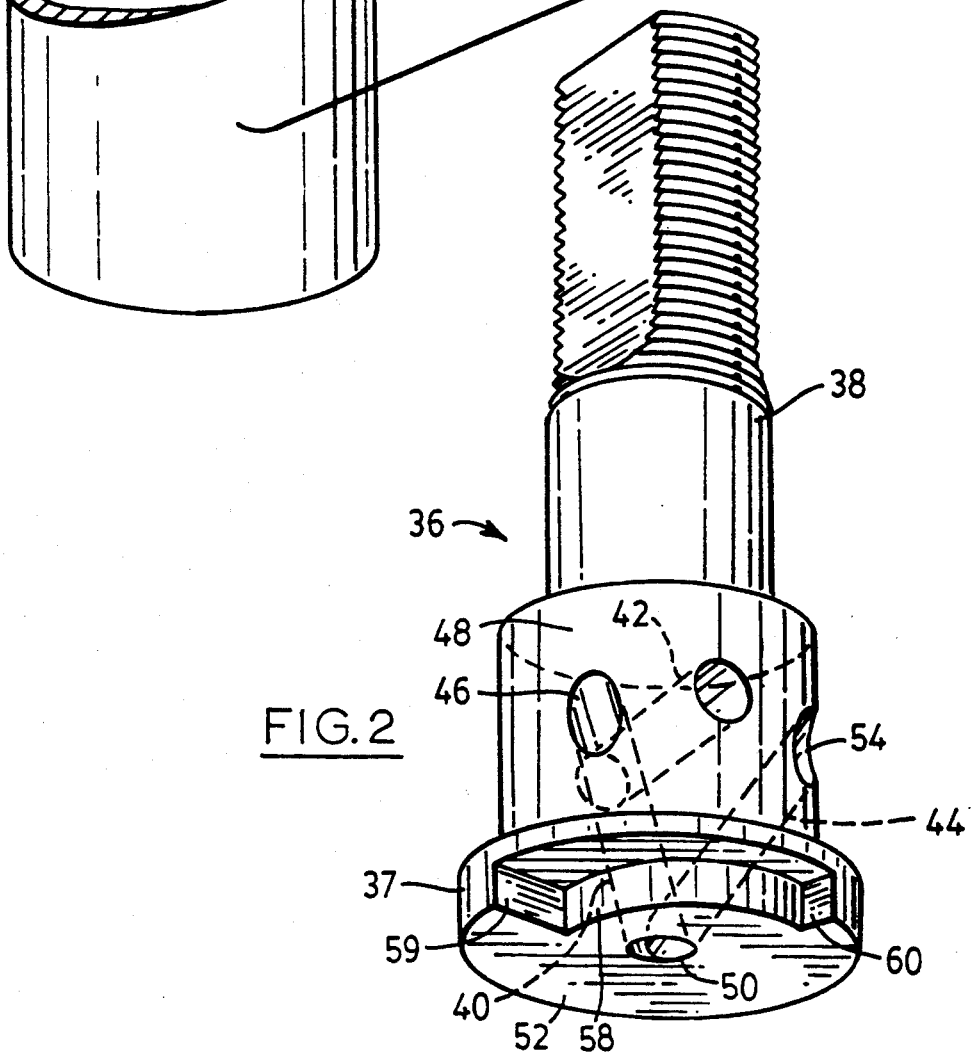
Figure 3:
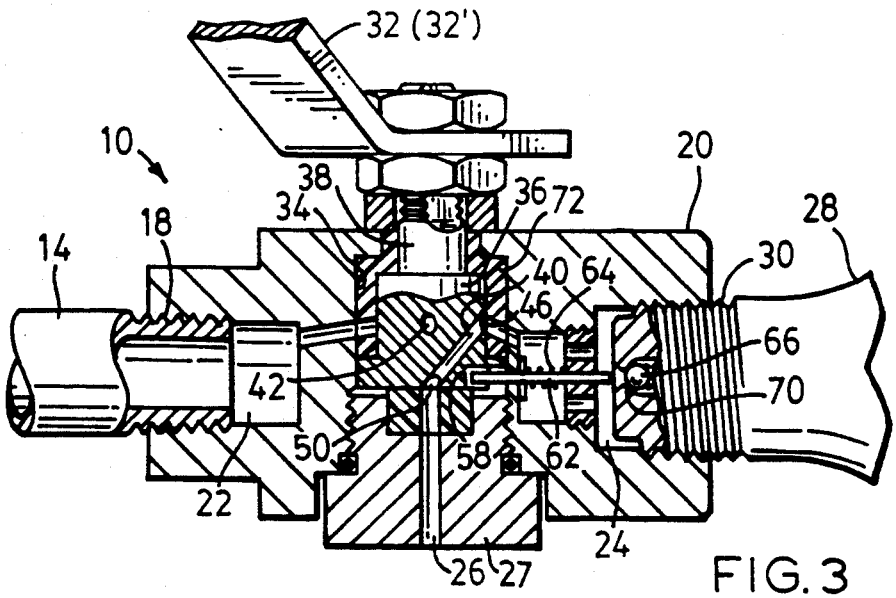
Figure 4:
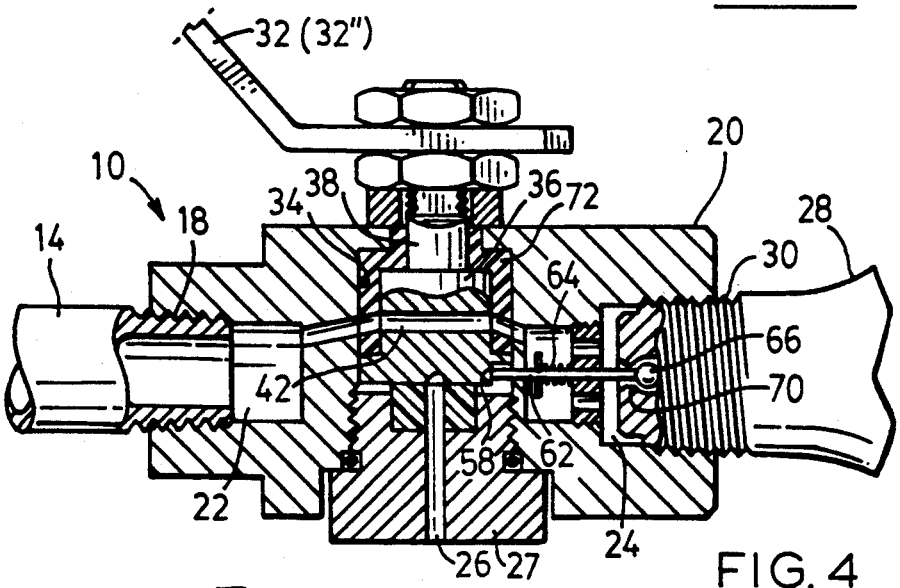
Figure 5:
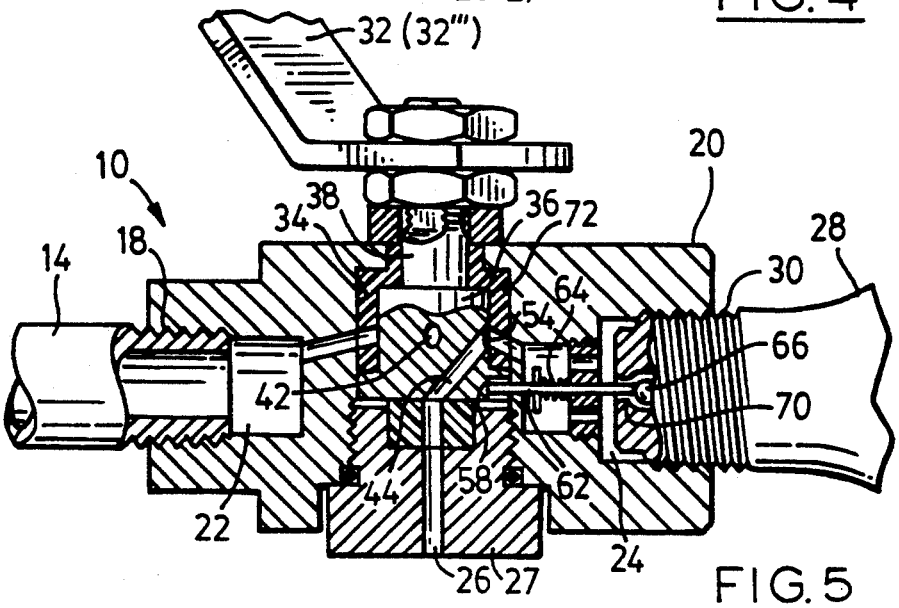

One embodiment of the invention will now be described, by way of example, with reference to the accompanying drawings, of which:

FIG. 1 is a perspective view of a valve assembly connected to a supply cylinder and to a smaller cylinder to be filled, FIG. 2 is a perspective view (on an enlarged scale) of the valve body, FIG. 3 is a sectional side view of the valve assembly with the valve body in the first position, FIG. 4 is a similar view showing the valve body in the second position, and FIG. 5 is a similar view showing the valve body in the third position.

Referring to the drawings, FIG. 1 shows a valve assembly 10 in accordance with the invention connected to a source of carbon dioxide gas, namely a supply cylinder 12 with an outlet pipe 14 and an outlet valve (not shown) operated in a conventional manner by manual rotation of a valve wheel 16. It will be understood that the outlet pipe 14 is also conventional, the open end of the outlet pipe 14 being externally screw-threaded at 18.

As shown in FIGS. 3 to 5, the valve assembly 10 has a cylindrical valve housing 20 with a supply port 22 in the form of an internally threaded bore in one end of the housing 20 and a fill port 24 in the form of an internally threaded bore in the opposite end of the housing 20. Valve housing 20 also has a vent port 26 in the form of a bore in a plug 27 screwed into the housing 20 mid-way therealong. The valve housing 20 is connected to the supply cylinder 12 by screwing the supply port 22 of the valve housing 20 on to the outlet pipe 14 of the supply cylinder 12.

A paintball gun cylinder 28 to be filled has an externally screw-threaded upper end portion 30 which is screwed into the fill port 24 of the valve housing 20 to connect the cylinder 28 to the valve assembly 10. The valve assembly 10 also has a manually operable lever 32 movable from a first position 32' shown in dotted outline in FIG.1 to a second position 32" shown in full lines and movable from the second position to a third position 32''' also shown in dotted outline.

The valve housing 20 has a cylindrical main chamber 34 with which the supply port 22, fill port 24 and vent port 26 communicate. As shown in FIGS. 2 to 5, the cylindrical valve body 36 is mounted in the chamber 34 and is angularly movable therein, the valve body 36 having a stem 38 which projects from the housing 20 and to which the manually operable lever 32 is secured to effect angular movement of the valve body 36 in the housing 20 between the three positions mentioned above. The valve body 36 has three passages 40, 42, 44 extending therethrough. The first passage 40 extends from a port 46 approximately half way up the cylindrical wall 48 of the valve body 36 through the valve body 46 to a port 50 in the bottom wall 52 of the valve body 36. The second passage 42 extends across the cylindrical valve body 36 from one side to the other at the same level as the port 46. The third passage 44 extends from a port 54 at the same level as the port 46 and the third passage 42 and on the opposite side of passage 42 to the port 46 to the port 50 in the bottom wall 52 of the valve body 36. The valve body 36 has an enlarged lower end portion 37 with a recess 58 extending from below the port 46 to below the port 56. The bottom of the recess 58 is shaped to act as a cam surface and the ends 59, 60 of the recess 58 act as stops as will be described in more detail later. The fill port 24 of the valve body 20 contains a slidably mounted actuating pin 62 which is resiliently biased by a spring 64 into engagement with the bottom of the recess 58.

The upper end portion 30 of the cylinder 28 to be filled has a conventional inlet/outlet valve with a spherical valve member 66 resiliently urged by a spring (not shown) on to an annular valve seat 70.

In use, the valve assembly 10 is connected to a supply cylinder 12 as described above. A paintball gun cylinder 28 to be filled is then connected to the fill port 24 of the valve assembly 10 as also described above. At this stage, the lever 32 is in the first position 32' shown in dotted outline in FIG.1. In this first position, shown in detail in FIG. 3, the cylindrical wall of the valve body 36 closes off the supply port 22 and port 46 is in communication will fill port 24. Passages in the valve assembly 10 between the upper end portion 30 of the cylinder 28 and the valve body 36 are therefore vented through the first passage 40 in the valve body 36 to the vent port 26 and accordingly to the atmosphere. Also, in this first position, actuating pin 62 is seated in the deepest portion of the recess 58 adjacent the end 59, the inlet/outlet valve in the cylinder 28 being closed.

The outlet valve in supply cylinder 12 is then opened by turning the valve wheel 16 in a conventional manner. The lever 32 is then moved to the second position 32" shown in detail in FIG. 4. This movement moves the port 46 in the valve body 36 out of communication with supply port 22 and puts the second passage 42 in communication with the supply port 22 and the fill port 24. At the same time, the bottom wall of the recess 58 cams the actuating pin 62 into engagement with the valve member 66 of the cylinder 28 and forces the valve member 66 away from the valve seat 70 to open the cylinder inlet/outlet valve. The cylinder 28 is therefore filled with carbon dioxide gas from the supply cylinder 12.

The lever 32 is then moved to the third position 32''' shown in detail in FIG. 5. This movement moves the second passage 42 out of communication with the supply port 22 and the fill port 24 and puts the port 54 of valve body 36 into communication with fill port 24. The bottom surface of recess 58 still maintains the actuating pin 62 in position to keep the cylinder valve open. The gas in cylinder 28 is therefore vented through passage 44 in the valve body 36 to the vent port 26 and hence to the atmosphere, thereby cooling the cylinder 28.

In the third position of the lever 32, actuating pin 62 engages the end wall 60 of recess 58, thereby acting as a stop to prevent further angular movement of the valve body 36 beyond the third position of lever 32.

The lever 32 is then returned to the second position 32", thereby re-filling the cooled container 28. The lever 32 is then returned to the first position 32', thereby permitting the actuating pin 62 to be moved by spring 64 away from spherical valve member 66 so that the valve in the cylinder 28 closes. At the same time, the valve body 36 closes the supply port 22 and vents the passages in the valve assembly 10 adjacent the upper end portion 30 of cylinder 28 through the passage 40 to the atmosphere. Filled cylinder 28 can therefore be safely removed from the fill port 24. It will be noted that, in this first position, acuating pin 62 engages end wall 59 of the recess 58, thereby acting as a stop preventing further angular movement of the valve body 36 beyond the first position of the lever 32.

It will thus be readily observed that the cylinder 28 can be easily, efficiently and safely filled with carbon dioxide gas from a supply cylinder by means of a valve assembly in accordance with the invention. A man skilled in the art will appreciate that appropriate sealing means will be provided between the valve body 36 and the valve housing 20. For example, a sleeve-like sealing member 72 of suitable plastic material secured in the valve housing 20 may surround the valve body 36 and the lower part of stem 38 in the manner shown, the sealing member 72 being provided with ports matching those in the valve body 36.

Other embodiments of the invention will also be readily apparent to a person skilled in the art, the scope of the invention being defined in the appended claims.

We claim:

1. A valve assembly operable to fill a container with pressurized gas from a source thereof and to vent the cylinder and associated passage means in the valve assembly to atmosphere, the cylinder having a valve with a valve member spring biased to a closed position, said valve assembly comprising:

a valve housing having a main chamber, a supply port connectable to a source of pressurized gas, a fill port connectable to a cylinder to be filled, and a vent port communicating with the atmosphere, said supply port, fill port and vent port communicating with the main chamber, a valve body mounted in the main chamber for movement therein and having first passage means operable in a first position of the valve body to connect the fill port to the vent port, second passage means operable in a second position of the valve body to connect the supply port to the fill port, and third passage means operable in a third position of the valve body to connect the fill port to the vent port, a valve opening member movably mounted in the valve housing and acutated by the valve body when the body is moved to said second and third positions to engage and move the valve member of a cylinder secured to the fill port to an open position, and means for positioning the valve body in the first, second and third positions, wherein, when a source of pressurized gas is connected to the supply port and a cylinder in connected to the fill port, positioning of the valve body in the first position causes the fill port to be vented through the first passage means and the vent port to the atmosphere, positioning the valve body in the second position causes the cylinder to be filled with gas from the source thereof, said gas passing through the second passage means, the fill port and the now-open cylinder valve into the cylinder, and positioning of the valve body in the third position causes the cylinder to be vented through the open cylinder valve, the fill port, the third passage means and the vent port to the atmosphere.

2. A valve assembly according to claim 1 including means to prevent the valve body from being moved from the first position directly to the third position or vice-versa without passing through the second position.

3. A valve assembly according to claim 1 wherein the valve body is angularly movable in the housing to said first, second and third positions.

4. A method of filling a cylinder with pressurized gas from a source thereof, said cylinder having a valve with a valve member spring biased to a closed position, said method including:

providing a valve assembly comprising a valve housing having a main chamber, a supply port, a fill port and a vent port, said supply port, fill port and vent port communicating with the main chamber, said vent port also communicating with the atmosphere, a valve body mounted in the main chamber for movement therein and having first passage means operable in a first position of the valve body to connect the fill port to the vent port, second passage means operable in a second position of the valve body to connect the supply port to the fill port and third passage means operable in a third position of the valve body to connect the fill port to the vent port, a valve opening member movably mounted in the valve housing and actuated by the valve body when the valve body is is moved to said second and third positions to engage and move the valve member of a cylinder secured to the fill port to an open position and means for positioning the valve body in the first, second and third positions, said method also including:

positioning the valve body in the first position to vent the fill port to the atmosphere, connecting a source of pressurized gas to the supply port, connecting a cylinder to the fill port, positioning the valve body in the second position to fill the cylinder with gas from the source thereof, positioning the valve body in the third position to vent the cylinder to the atmosphere, positioning the valve body in the second position to fill the cylinder with gas, positioning the valve body in the first position to vent the fill port to the atmosphere, and disconnecting the cylinder from the fill port.

* * * * *